US007059163B2

(12) United States Patent
Hartung et al.

(10) Patent No.: US 7,059,163 B2
(45) Date of Patent: Jun. 13, 2006

(54) ROLL STAND COMPRISING A CROWN-VARIABLE-CONTROL (CVC) ROLL PAIR

(75) Inventors: Hans Georg Hartung, Pulheim (DE); Klaus Klamma, Hilchenbach (DE); Wolfgang Rohde, Dormagen (DE); Jürgen Seidel, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 307 days.

(21) Appl. No.: 10/344,054

(22) PCT Filed: Jul. 25, 2001

(86) PCT No.: PCT/EP01/08581

§ 371 (c)(1),
(2), (4) Date: Jun. 30, 2003

(87) PCT Pub. No.: WO02/11916

PCT Pub. Date: Feb. 14, 2002

(65) Prior Publication Data

US 2004/0003644 A1 Jan. 8, 2004

(30) Foreign Application Priority Data

Aug. 10, 2000 (DE) ..... 100 39 035

(51) Int. Cl.
*B21B 39/20* (2006.01)

(52) U.S. Cl. ..... 72/252.5; 72/247; 72/241.8

(58) Field of Classification Search ..... 72/243, 72/252.5, 241.8
See application file for complete search history.

(56) References Cited

U.S. PATENT DOCUMENTS 4,881,396 A * 11/1989 Seidel et al. ..... 72/247
6,324,881 B1 * 12/2001 Benedetti et al. ..... 72/247
2005/0034501 A1 * 2/2005 Seilinger et al. ..... 72/252.5

FOREIGN PATENT DOCUMENTS

EP 0294544 12/1988

OTHER PUBLICATIONS

Patent Abstracts of Japan, vol. 1995, No. 011, Feb. 28, 1995 & JP 06 285518 A ) Kobe Steel Ltd) , Oct. 11, 1994.
Patent Abstracts of Japan, Vo. 011 , No. 166, (M-593) , May 28, 1987 & JP 61 296904 A (Nippon Steel Corp) , Dec. 27, 1986.

* cited by examiner

*Primary Examiner*—Dmitry Suhol
(74) *Attorney, Agent, or Firm*—Friedrich Kueffner

(57) ABSTRACT

The invention relates to a roll stand comprising a crown-variable-control (CVC) roll pair, preferably a CVC working roll pair and a back-up roll pair, which comprise a contact area (B cont) in which a horizontally active torque (M) acts that leads to a twisting of the rolls and thus to axial forces in the roll bearings. In order to keep the axial forces in the roll bearings as small as possible, the torque (M) is minimized by an appropriate CVC grinding.

2 Claims, 4 Drawing Sheets

ROLL STAND COMPRISING A CROWN-VARIABLE-CONTROL (CVC) ROLL PAIR

The invention pertains to a roll stand with a pair of CVC rolls, preferably with a pair of CVC working rolls and a pair of backup rolls, which have a contact area in which a horizontally acting torque is present, which leads to a skewing of the rolls and thus to axial forces in the roll bearings.

EP 0,049,798 B1 describes a rolling mill with working rolls which are supported either by backup rolls or by backup rolls and intermediate rolls, where the working rolls and/or the backup rolls and/or the intermediate rolls can be displaced axially with respect to each other and where each roll of at least one of these roll pairs is provided with a curved contour which extends toward one of the ends of the barrel, which contour extends toward each of the two opposite ends of each of the two rolls across a portion of the width of the rolled stock. In this case the cross section of the rolled strip is affected almost exclusively by the axial displacement of the rolls provided with the curved contour, so that there is no need to bend the rolls. The curved contours of the two rolls extend over the entire length of the barrel and have shapes which, in a certain axial position of the two rolls, fit together in a complementary manner.

EP 0,294,544 B1 discloses rolls with contours which are described by a fifth-degree polynomial. This roll shape allows even more complete corrections of the rolled strip.

To minimize effectively the forces acting on the bearings and the rolling forces acting at an angle, it is proposed in JP-A 61[1986]-296,904 that the contours of the working rolls be curved in such a way that they intersect a line parallel to the roll axis three times. The curved contours extend along both rolls in each case toward opposite ends in such a way that the total diameter formed by the two rolls remains the same over the entire length of the rolls.

In the two documents cited above, however, no attention is paid to the fact that the roll gap and the profile adjusting range are not the only important variables when CVC rolls are used for rolling. The amount of attention which must be paid to the roll bearings is also affected by the axial forces acting on the rolls, especially those which can arise when an unsuitable grind is used.

Because of the difference, although small, between the diameters along the length of the barrel of a CVC roll, different contact forces and peripheral velocities are produced.

The circumferential velocities are equal at the points on the paired rolls which have the same diameter. At the other points on the contact area of the rolls, the diameter and thus the circumferential velocity of one roll is smaller or larger than those of the other roll. Thus, depending on the how the directions of the coordinates are defined, a negative or positive velocity differences are produced along the contact area between the paired rolls.

These different relative velocities and their different directions lead to different circumferential forces, which act in different directions. The distribution of the circumferential forces on the rolls results in a torque acting around the center of the stand, which can lead to a skewing of the rolls and thus to axial forces in the roll bearings.

It is known from JP-A 6[1994]-285,518 that the contour of working rolls which can shift axially with respect to each other can be designed according to a higher-degree polynomial, where the highest term pertains to the distance from the center of the roll in the direction of the roll axes and three other terms pertain to the point symmetry. The contours of the working rolls are designed so that the integration of the product of the roll radius times the distance from the center of the roll in the direction of the roll axes over the entire contact length with another roll, such as a backup roll, results in a value of zero. Providing the working rolls with a contour of this type makes it possible to reduce the forces which act on the bearings as a result of, for example, the slanted position of the working rolls.

The invention is based on the task of providing measures for a roll stand of the general type in question by means of which the axial forces acting on the roll bearings are minimized. The task is accomplished by the characterizing features of claim 1. Simply by modifying the shape of the CVC rolls, the torques acting in the horizontal direction are minimized without additional effort.

A suitable modification of the shape is achieved according to the invention by defining the change in the radius of the CVC roll by the polynomial equation:

$$R(x)=a_0+a_1ox+a_2ox^2+\ldots a_nox^n$$

and by using preferably the so-called wedge factor $a_1$ as an optimization parameter. The contour of a CVC roll is defined by a third-degree polynomial:

$$R(x)=a_0+a_1x+a_2x^2+a_3x^3$$

where:

L=the radius of the CVC roll;

$a_i$=the polynomial coefficient; and x=the coordinate in the longitudinal direction of the barrel.

In the case of CVC rolls of higher degrees, additional polynomial terms ($a_4$, $a_5$, etc.) are also taken into account.

The polynomial coefficient $a_0$ is obtained from the actual radius of the roll. The polynomial coefficients $a_2$, $a_3$, $a_4$, $a_5$, etc., are defined so that the desired adjusting range for the CVC system is obtained. The polynomial coefficient $a_1$ is independent of the adjusting range and of the linear load between the rolls and can thus be freely selected. This wedge factor or linear component $a_1$ can be selected so that minimal axial forces are produced when CVC rolls are used.

For reasons of practicality, the optimum wedge factor $a_1$ is determined offline as a mean value of various displacements of the CVC rolls with respect to each other (e.g., minimum, neutral, and maximum displacement). Although it is true that, because a mean value is calculated, the axial forces of the roll bearings are not completely compensated, a minimum value is nevertheless obtained over the entire adjusting range of the rolls.

After the wedge shape of the CVC grind has been optimized, the tangents which touch the diameter at one end on the concave side of the roll and the convex part of the roll and the tangent which touches the diameter at the other end of the roll (on the convex side of the roll) and the concave part of the roll are parallel to each other but are slanted to the axes of the rolls by the optimum wedge angle. In the case of CVC working rolls with the conventional grind, which are laid out with the goal of obtaining the smallest possible diameter differences, these tangents are parallel to the axes of the rolls.

On the basis of the mathematical considerations and the empirical data, it has been found advantageous for the wedge factor $a_1$ for a roll described by a third-degree polynomial equation to be in the range of $$a_1 = -\frac{1}{20} \text{ to } -\frac{5}{20} \cdot a_3 \cdot b_{cont}^2.$$

Similar reasoning leads to the conclusion that the wedge factor $a_1$ for a roll described by a fifth-degree polynomial equation can be described by the expression:

$$a_1 = f_1 \cdot a_3 \cdot b_{cont}^2 + f_2 \cdot a_5 \cdot b_{cont}^4,$$

where:

$$f_1 = -\frac{1}{20} \text{ to } -\frac{5}{20}$$

and $$f_2 = 0 \text{ to } -\frac{7}{112}$$

Additional features of the invention can be derived from the claims and from the following description as well as from the drawing, in which exemplary embodiments of the invention are illustrated schematically:

FIGS. 1*a,* 1*b,* and 1*c* show a pair of CVC working rolls shifted into various positions with respect to each other along with their backup rolls and also the linear load distribution in the roll gap and between the rolls;

Figure 1C:
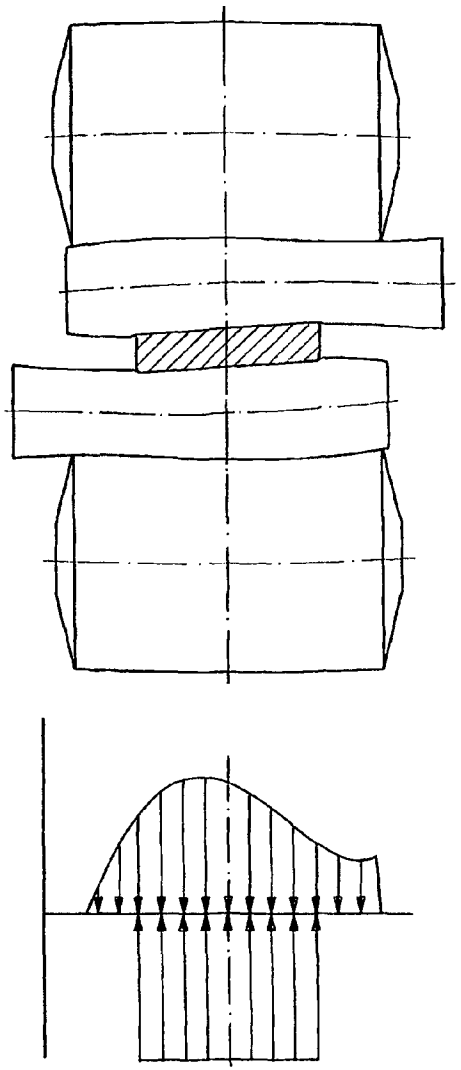
Figure 1B:
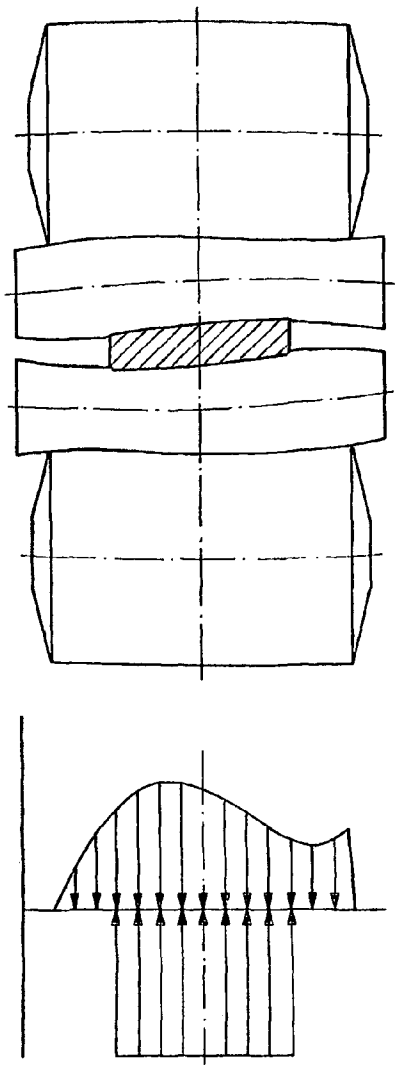
Figure 1A:
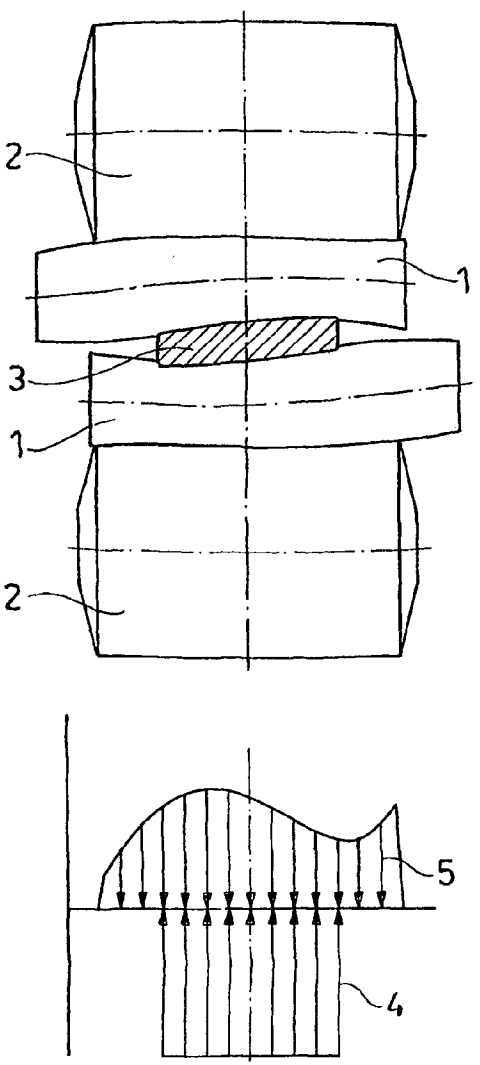

FIGS. 1*a,* 1*b,* and 1*c* show the CVC working rolls 1 shifted into different positions with respect to each other. The working rolls 1 are supported by the backup rolls 2. A rolled strip 3 is located between the working rolls 1.

The load in the roll gap is assumed to be constant across the rolled strip 3 and to be independent of the displacement of the working rolls 1 with respect to each other. It is indicated by the arrows 4. The load between the CVC working rolls 1 and the backup rolls 2 is distributed unequally over their contact area $b_{cont}$ and changes with the displacement of the working rolls 1. This load is indicated by the arrows 5. The sum of the loads illustrated by the arrows 4 is equal and opposite to the sum of the loads illustrated by the arrows 5.

Figure 2:
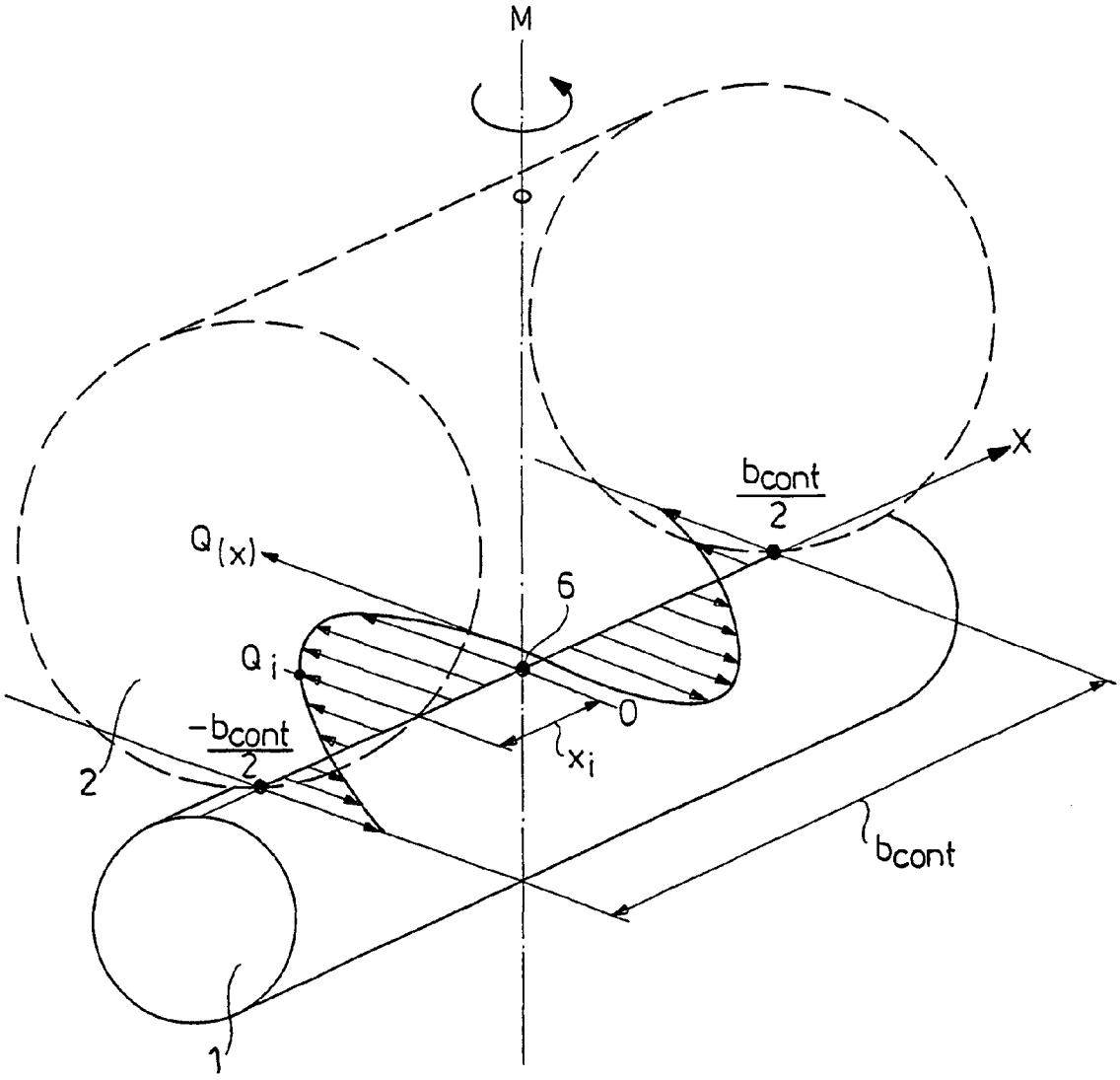
FIG. 2 shows the distribution of the circumferential forces in the contact area between two rolls.

According to FIG. 2, the load arrows 5 resulting from the shape of the rolls and the local positive or negative relative velocity lead to different circumferential forces $Q_i$ over the contact width $b_{cont}$. This distribution of the circumferential roll force $Q_i$ causes a torque M around the center 6 of the roll stand, which can lead to the skewing of the rolls 1, 2 and thus to axial forces in their bearings.

This can be prevented by giving the rolls an appropriate grind. In the case of CVC rolls with the roll contour according to a third-degree polynomial equation according to:

$$R(x)=a_0+a_1ox+a_2ox^2+a_3ox^3$$

only the factor $a_1$, the so-called wedge factor, is available for varying the grind pattern, because the polynomial coefficient $a_0$ determines the associated radius of the roll, and the polynomial coefficients $a_2$, $a_3$, $a_4$, $a_5$, etc., determine the desired adjusting range of the CVC system. Only the wedge factor $a_1$ is independent of the adjusting range and the linear load between the rolls and can thus be freely selected. In the case of CVC rolls with a contour defined by a third-degree polynomial, the wedge factor $a_1$ leads to a minimum torque M when it is in the range of:

$$a_1 = -\frac{1}{20} \text{ to } -\frac{5}{20} \cdot a_3 \cdot b_{cont}^2.$$

For CVC rolls with a contour defined by a 5th-degree polynomial, the torque M reaches a minimum when the wedge factor is:

$$a_1 = f_1 \cdot a_3 \cdot b_{cont}^2 + f_2 \cdot a_5 \cdot b_{cont}^4,$$

where:

$$f_1 = -\frac{1}{20} \text{ to } -\frac{5}{20}$$

and $$f_2 = 0 \text{ to } -\frac{7}{112}$$

Figure 3:
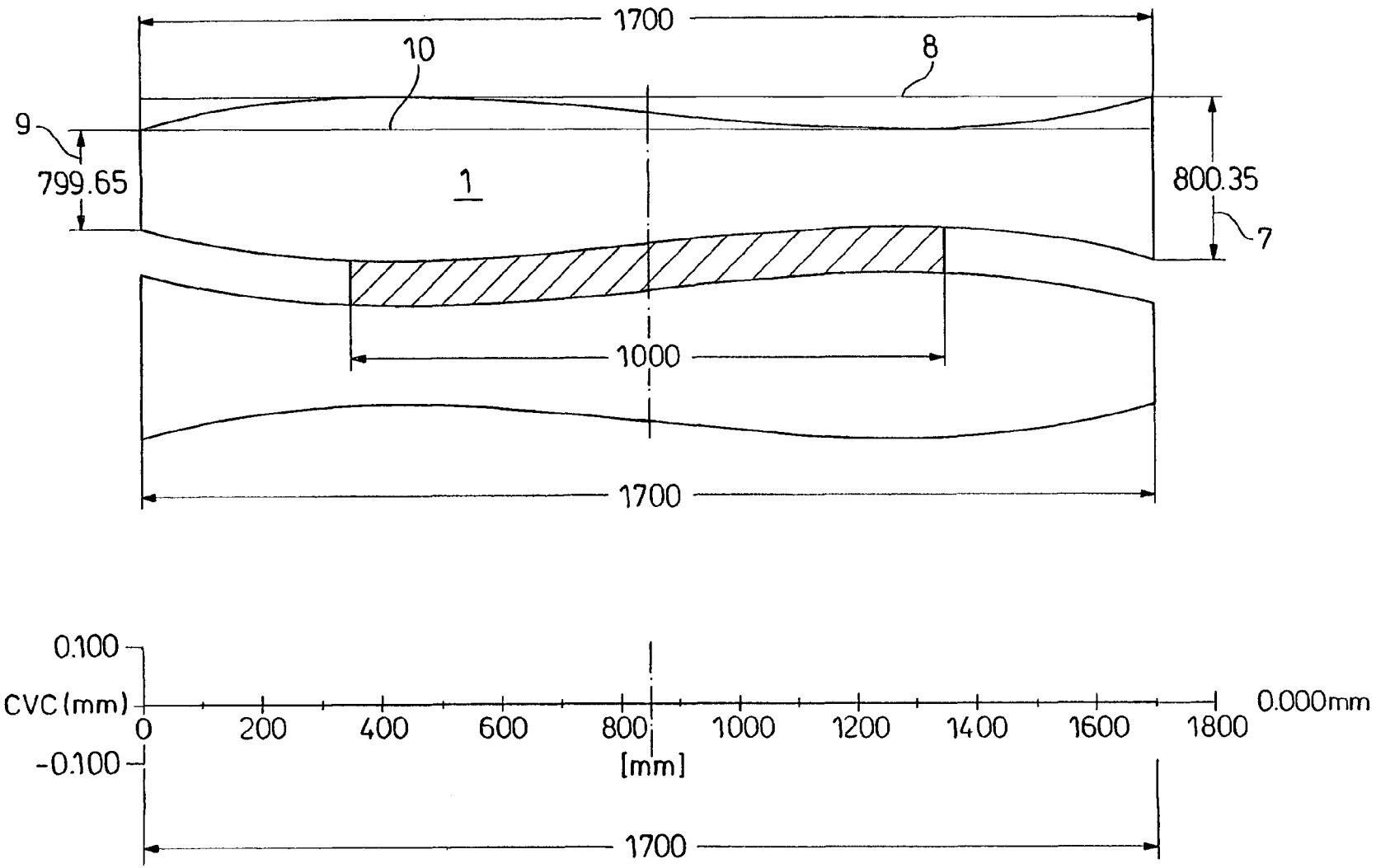
FIG. 3 shows a pair of CVC working rolls with a conventional grind.
Figure 4:
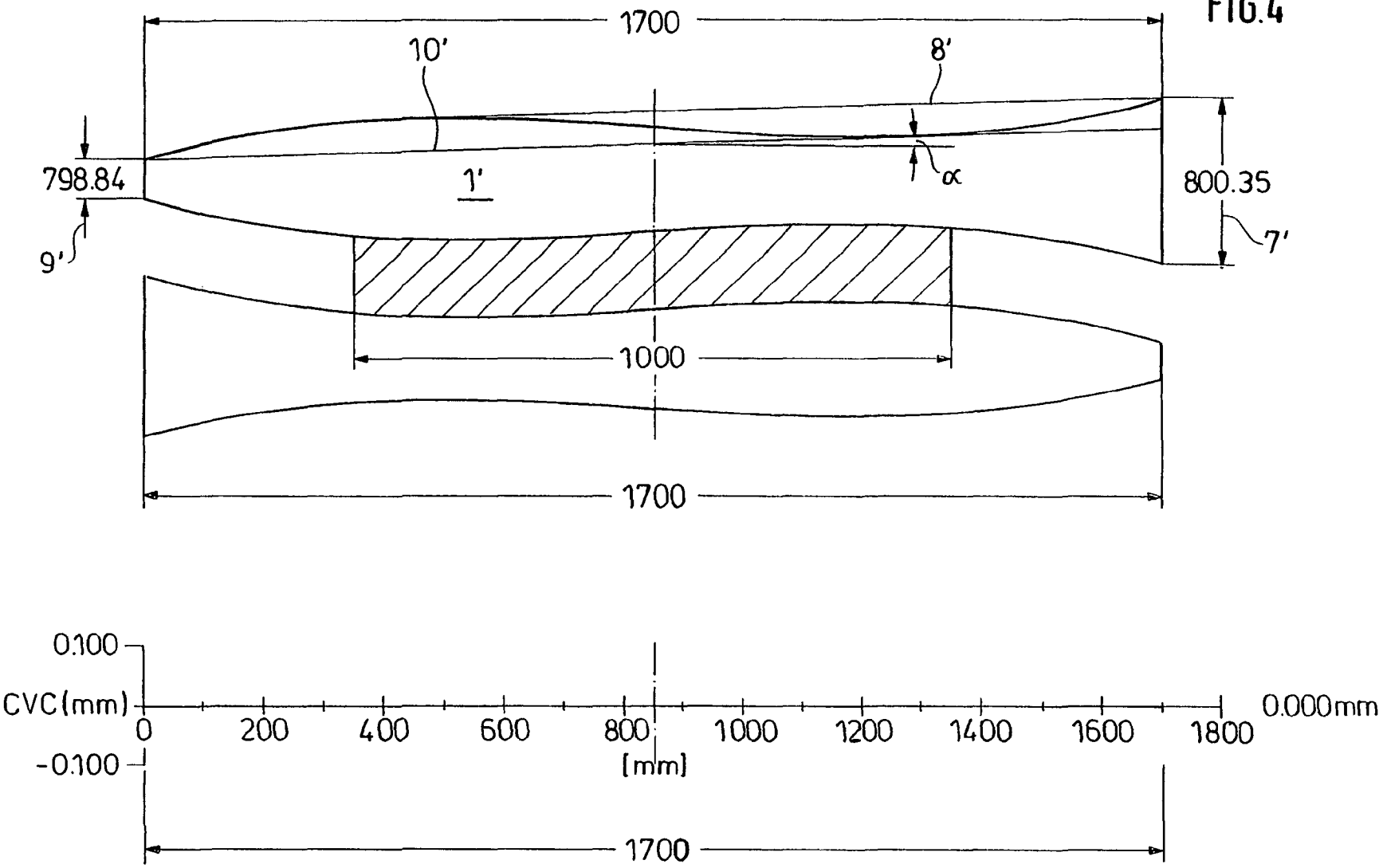
FIG. 4 shows a pair of CVC working rolls with an optimum wedge shape.

FIG. 3 shows a conventionally ground pair of CVC working rolls, which has been laid out with the goal of achieving the smallest possible diameter differences. The tangent 8, which contacts a diameter 7 at one end and the convex part of the roll, and the other tangent 10, which contacts the diameter 9 at the other end and the concave part of the roll, are parallel to the axes of the conventionally ground working rolls. In contrast, the corresponding tangents of the CVC rolls according to FIG. 4, which were laid out with the optimum wedge shape, are parallel to each other but are slanted to the roll axes by the optimum wedge angle α.

| List of Reference Numbers | |
|---|---|
| 1, 1' | CVC working rolls |
| 2 | backup rolls |
| 3 | rolled strip |
| 4 | arrow (load in the roll gap) |
| 5 | arrow (load between the working roll 1 and the backup roll 2) |
| 6 | center of the rolling stand |
| 7, 7' | diameter at the end of the roll |
| 8, 8' | tangent |
| 9, 9' | diameter at the other end of the roll |
| 10, 10' | other tangent |

The invention claimed is:

1. Rolling stand with a pair of CVC rolls, preferably a pair of CVC working rolls (1, 1') and a pair of backup rolls (2), which have a contact area $b_{cont}$, in which a horizontally-acting torque (M) is present, which leads to a skewing of the rolls (1, 2) and thus to axial forces in the roll bearings, wherein the torque (M) is minimized by a suitable CVC grind, where the change in the radius (the contour) of the CVC rolls is described by the polynomial equation $$R(x)=a_0+a_1ox+a_2ox^2+\ldots a_nox^n$$

where:

R(x)=the change in the radius;

x=the coordinate in the longitudinal direction of the barrel;

$a_0$=the actual radius of the roll;

$a_1$=the optimization parameter (wedge factor), which is determined offline as a mean value from various displacements of the CVC rolls with respect to each other; and $a_2$ to $a_n$=the adjusting range of the CVC system, where the CVC grind with an optimized wedge shape is designed so that a tangent (8'), which contacts a diameter (7') at one end and a convex part of the roll (1') and a tangent (10') which contacts a diameter (9') at the other end and a concave part of the roll (1') are parallel to each other but slanted to the roll axes by an optimum wedge angle ($\alpha$).

2. Rolling stand according to claim 1, wherein the optimum wedge factor $a_1$ for a roll (1, 1') with a contour according to a 3rd-degree polynomial is in the range $$a_1 = f_1 \cdot a_3 \cdot b_{cont}^2$$

and for a roll (1, 1') with a contour according to a 5th-degree polynomial is in the range of:

$$\text{where: } a_1 = f_1 \cdot a_3 \cdot b_{cont}^2 + f_2 \cdot a_5 \cdot b_{cont}^4$$

$$f_1 = -\frac{1}{20} \text{ to } -\frac{5}{20}$$

$$\text{and } f_2 = 0 \text{ to } -\frac{7}{112}$$

* * * * *